US005244723A

United States Patent [19]

Anderson et al.

[11] Patent Number: 5,244,723

[45] Date of Patent: Sep. 14, 1993

[54] FILAMENTS, TOW, AND WEBS FORMED BY HYDRAULIC SPINNING

[75] Inventors: Richard A. Anderson; Jark C. Lau, both of Roswell, Ga.

[73] Assignee: Kimberly-Clark Corporation, Neenah, Wis.

[21] Appl. No.: 818,026

[22] Filed: Jan. 3, 1992

[51] Int. Cl.[5] ..... D01D 5/088; D04H 3/03; D04H 3/16

[52] U.S. Cl. ..... 428/283; 156/167; 264/177.13; 264/177.19; 264/177.17; 264/210.8; 264/211.12; 264/211.14; 428/288; 428/296; 428/399

[58] Field of Search ..... 264/210.8, 177.17, 211.12, 264/211.14, 177.13, 177.19; 428/399, 288, 296, 283; 156/167

[56] References Cited

U.S. PATENT DOCUMENTS

| | | | |
|---|---|---|---|
| 3,016,599 | 1/1962 | Perry | 28/78 |
| 3,148,101 | 9/1964 | Allman et al. | 156/167 |
| 3,185,613 | 5/1965 | Adams | 428/399 |
| 3,341,394 | 9/1967 | Kinney | 428/292 |
| 3,655,862 | 4/1972 | Dorschner | 264/290 |
| 3,680,301 | 8/1972 | Michel | 428/399 |
| 3,691,748 | 9/1972 | Buyano | 428/399 |
| 3,692,618 | 9/1972 | Dorschner | 428/227 |
| 3,704,198 | 11/1972 | Prentice | 428/198 |
| 3,705,068 | 12/1972 | Dobo | 156/141 |
| 3,755,527 | 8/1973 | Keller | 264/210 |
| 3,802,817 | 4/1974 | Matsuki | 425/66 |
| 3,849,241 | 11/1974 | Butin | 428/137 |
| 3,853,651 | 12/1974 | Porte | 156/73.6 |
| 3,959,421 | 5/1976 | Weber | 264/6 |
| 3,978,185 | 8/1976 | Buntin | 264/93 |
| 4,059,950 | 11/1977 | Negishi | 428/399 |
| 4,064,605 | 12/1977 | Akiyama | 28/103 |
| 4,091,140 | 5/1978 | Harmon | 428/288 |
| 4,100,319 | 7/1978 | Schwartz | 428/171 |
| 4,100,324 | 7/1978 | Anderson | 428/288 |
| 4,118,531 | 10/1978 | Hauser | 428/224 |
| 4,340,563 | 7/1982 | Appel | 264/518 |
| 4,340,631 | 7/1982 | Endo | 428/399 |
| 4,405,297 | 9/1983 | Appel | 425/72 |
| 4,434,204 | 2/1984 | Harman | 428/198 |
| 4,521,364 | 6/1985 | Norota et al. | 428/399 |
| 4,627,811 | 12/1986 | Greiser | 425/72 |
| 4,644,045 | 2/1987 | Fowells | 526/348 |
| 4,663,220 | 5/1987 | Wisneski | 428/221 |
| 5,171,504 | 12/1992 | Cuculo et al. | 264/210.3 |

OTHER PUBLICATIONS

V. A. Wente, "Superfine Thermoplastic Fibers", vol. 48, No. 8, pp. 1342–1346 (1956).

V. A. Wente et al., "Manufacture of Superfine Organic Fibers", NRL Report 4364 (111437), dated May 25, 1954.

Robert R. Butin and Dwight T. Lohkamp, "Melt Blowing–A One-Step Web Process for New Nonwoven Products", vol. 56, No. 4, pp. 74–77 (1973).

*Primary Examiner*—James C. Cannon

*Attorney, Agent, or Firm*—William E. Maycock

[57] ABSTRACT

A method of forming substantially continuous filaments which involves the steps of (1) extending a molten thermoplastic polymer through a die having a plurality of orifices to give a plurality of substantially continuous filaments; (2) quenching the filaments by contacting them with a quenching fluid having a temperature less than that of the filaments and a zero to high imposed velocity which, if other than zero, has a component which is in a direction other than parallel with the movement of filaments; (3) entraining and drawing the filaments in a nozzle with an attenuating liquid having a linear speed of at least about 400 feet/minute; and (4) collecting the drawn filaments. The filaments have an average diameter in the range of from about 5 to about 75 micrometers and a high variability of filament diameter from filament to filament and along the length of any given filament. In addition, at least some of such filaments are present as filament bundles. Such filaments can be collected as tow or can form the basis of a nonwoven web which is characterized by minimal filament-to-filament fusion bonding. The preferred thermoplastic polymers are polyolefins, with the most preferred polyolefin being polypropylene.

39 Claims, 7 Drawing Sheets

FILAMENTS, TOW, AND WEBS FORMED BY HYDRAULIC SPINNING

CROSS-REFERENCES TO RELATED APPLICATIONS

The application of the hydraulic spinning process described and claimed herein to the formation of filaments, tow, and webs having delayed wettability is described and claimed in copending and commonly assigned application Ser. No. 817,267, now abandoned, entitled FILAMENTS, TOW, AND WEBS FORMED BY HYDRAULIC SPINNING AND HAVING DELAYED WETTABILITY and filed of even data in the names of Ronald Sinclair Nohr, Richard Allen Anderson, and John Gavin MacDonald.

BACKGROUND OF THE INVENTION

The present invention relates to the formation of filaments, tow, and nonwoven webs. More particularly, the present invention relates to the formation of filaments, tow, and nonwoven webs from a thermoplastic polymer by hydraulic spinning.

Traditional melt-extrusion process for the formation of fibers or filaments, tow, and nonwoven webs from a thermoplastic polymer typically involve melting the thermoplastic polymer, extruding the molten polymer through a plurality of orifices to form a plurality of threadlines or filaments, attenuating the filaments by mechanical drawing or by entrainment in a rapidly moving first stream of gas, cooling the filaments with a second stream of gas, and gathering the cooled filaments by randomly depending them on a moving foraminous surface. The most common and well known of these processes are spinning, melting blowing, coforming, and spunbonding.

Meltblowing references include, by way of example, U.S. Pat. Nos. 3,016,559 to Perry, Jr., 3,704,198 to Prentice, 3,755,527 to Keller et al., 3,849,241 to Butin et al. et al., 3,978,185 to Butin et al., and 4,663,220 to Wisneski et al. See, also, V. A. Wente, "Superfine Thermoplastic Fibers", *Industrial and Engineering Chemistry,* Vol. 48, No. 8, pp, 1342–1346 (1956); V. A. Wente et al., "Manufacture of Superfine Organic Fibers", Navy Research Laboratory, Washington, D.C., NRL Report 4364 (111437), dated May 25, 1954, United States Department of Commerce, Office of Technical Services; and Robert R. Butin and Dwight T. Lohkamp, "Melting Blowing—A One-Step Web Process for New Nonwoven Products", *Journal of the Technical Association of the Pulp and Paper Industry,* Vol. 56, No. 4, pp. 74–77 (1973).

Of interest with respect to melting blowing techniques is U.S. Pat. No. 3,959,421 to Web et al. The patent relates to a method for the rapid quenching of meltblown fibers. A liquid, such as water, is sprayed into the gas stream containing meltblown microfibers to rapidly cool the fibers and the gas. The quenching liquid preferably is sprayed into the gas stream from opposite sides, and the temperature of the gas stream preferably is substantially higher than the boiling point of the quenching liquid in the area where the liquid is sprayed into the gas stream.

Coforming references (i.e., references disclosing a meltblowing process in which fibers or particles are comingled with the meltblown fibers as they are formed) include U.S. Pat. Nos. 4,100,324 to Anderson et al. and 4,118,531 to Hauser.

Finally, spunbonding references include, among others, U.S. Pat. Nos. 3,341,394 to Kinney, 3,655,862 to Dorschner et al., 3,692,618 to Dorschner et al., 3,705,068 to Dobo et al., 3,802,817 to Matsuki et al., 3,853,651 to Porte, 4,064,605 to Akiyama et al., 4,091,140 to Harmon, 4,100,319 to Schwartz, 4,340,563 to Appel and Morman, 4,405,297 to Appel and Morman, 4,434,204 to Hartman et al., 4,627,811 to Greiser and Wagner, and 4,644,045 to Fowells.

The above cited process have in common the attenuation of the threadlines or filaments by entrainment in a rapidly moving gaseous stream. It now has been discovered, however, that unique fibers and nonwoven webs can be obtained through the use of a liquid stream to attenuate the extruded filaments, in place of a gaseous stream.

SUMMARY OF THE INVENTION

It therefore is an object of the present invention to provide a novel method of producing from a thermoplastic polymer filaments having unique characteristics.

It also is an object of the present invention to provide a novel method of forming from a thermoplastic polymer a nonwoven web having unique characteristics.

A further object of the present invention is to provide melt-extruded filaments having unique characteristics.

Another object of the present invention is to provide a tow comprising filaments having unique characteristics.

Yet another object of the present invention is to provide a nonwoven web having unique characteristics.

These and other objects will be apparent to one having ordinary skill in the art from a consideration of the specification and claims which follow.

Accordingly, the present invention provides a method of forming substantially continuous filaments which comprises the steps of:

A. extruding a molten thermoplastic polymer through a die having a plurality of orifices to give a plurality of substantially continuous filaments;

B. contacting said plurality of filaments with a quenching fluid having a temperature less than that of said plurality of filaments and a zero to high imposed velocity which, if other than zero, has a component which is in a direction other than parallel with the movement of said filaments;

C. entraining and drawing said plurality of filaments in a nozzle with an attenuating liquid having a linear velocity of at least about 2 m/s; and D. separating the drawn filaments from the major portion of said attenuating liquid.

The present invention also provides a method of forming a nonwoven web which is characterized by minimal filament-to-filament fusion bonding, which method comprises the steps of:

A. extruding a molten thermoplastic polymer through a die having a plurality of orifices to give a plurality of substantially continuous filaments;

B. contacting said plurality of filaments with a quenching fluid having a temperature less than that of said plurality of filaments and a zero to low imposed velocity which, it other than zero, has a component which is in a direction other than parallel with the movement of said filaments;

C. entraining and drawing said plurality of filaments in a nozzle with an attenuation liquid having a linear speed of at least about 2 m/s; and D. collecting the drawn filaments on a moving foraminous surface as a web of filaments and separating the major portion of the drawing liquid from said drawn filaments.

The present invention further provides melt-extruded filaments prepared from a thermoplastic polymer, in which:

A. said filaments have an average diameter in the range of from about 5 to about 75 micrometers;

B. said filaments have a high variability of filament diameter from filament to filament and along the length of any given filament; and C. at least some of said filaments may be present as filament bundles.

In preferred embodiments, the thermoplastic polymer employed in the method of the present invention is a polyolefin. In other preferred embodiments, the thermoplastic polymer is polypropylene. In yet other preferred embodiments, the drawn filaments are gathered as tow.

DETAILED DESCRIPTION OF THE INVENTION

Figure 1:
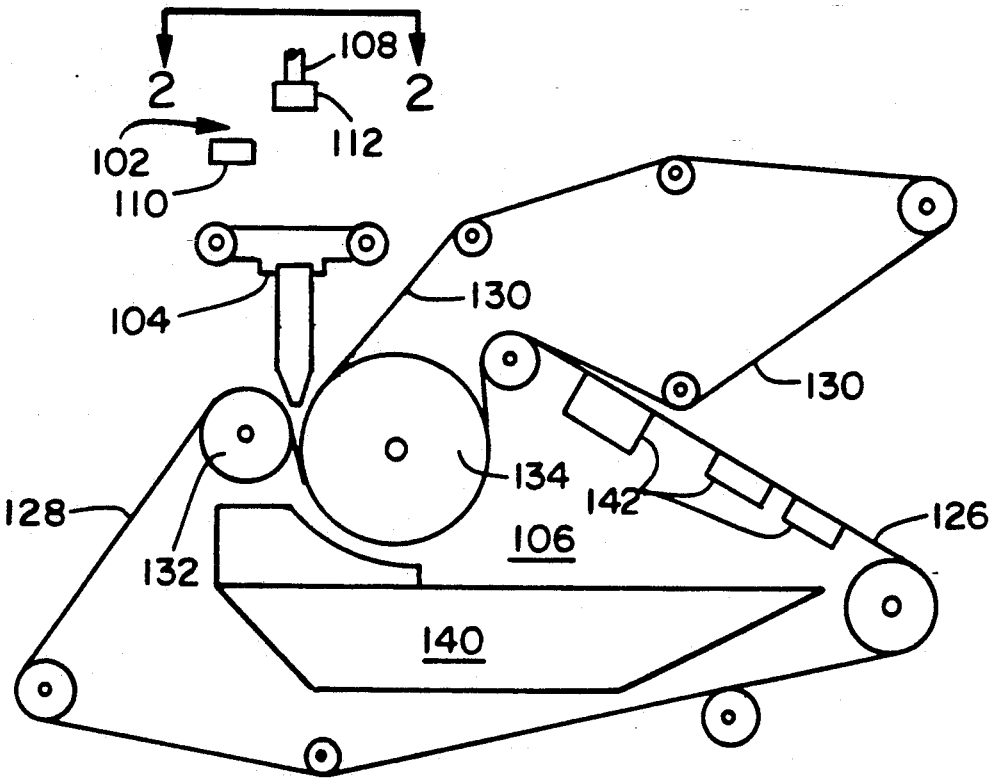
FIG. 1 is a schematic representation of the apparatus employed in the method of the present invention.

The primary focus of the present invention is the formation of filaments by hydraulic spinning. As used herein, the term "hydraulic spinning" refers to the use of a liquid to draw or attenuate the filaments resulting from the extrusion of a thermoplastic polymer through a die having a plurality of orifices. The production of such filaments involves the steps of:

A. extruding a molten thermoplastic polymer through a die having a plurality of orifices to give a plurality of substantially continuous filaments;

B. contacting said plurality of filaments with a quenching fluid having a temperature less than that of said plurality of filaments and a zero to high imposed velocity which, if other than zero, has a component which is in a direction other than parallel with the movement of said filaments.

C. entraining and drawing said plurality of filaments in a nozzle with an attenuating liquid having a linear speed of at least about 2 m/s; and D. separating the drawn filaments from the major portion of said attenuating liquid.

The filaments, whether or not they are collected as tow or a nonwoven web, can have an average diameter in the range of from about 5 to about 75 micrometers and have a high variability of filament diameter from filament to filament and along the length of any given filament. In addition, at least some of the filaments may be present as filament bundles. Because the entraining and drawing process involves little cross-flow or cross-directional turbulence, the filaments which emerge from the apparatus tend to be highly oriented in the machine direction.

If desired, the drawn filaments can be collected as a tow or as a nonwoven web on a moving foraminous surface. Because the filaments which emerge from the apparatus tend to be highly oriented, the resulting nonwoven web also tends to be highly oriented in the machine direction. Moreover, the rapid quenching of the molten filament surfaces prevents or reduces filament-to-filament fusion bonding.

As used herein, the term "thermoplastic polymer" is meant to include any thermoplastic polymer which is capable of being melt-extruded to form filaments. Examples of thermoplastic polymers include, by way of illustration only, end-capped polyacetals, such as poly(oxymethylene) or polyformaldehyde, poly(trichloroacetaldehyde), poly(n-valeraldehyde), poly(acetaldehyde), poly(propionaldehyde), and the like; acrylic polymers, such as polyacrylamide, poly(acrylic acid), poly(methacrylic acid), poly(ethyl acrylate), poly(methyl methacrylate), and the like; fluorocarbon polymers, such as poly(tetrafluoroethylene), perfluorinated ethylene-propylene copolymers, ethylene-tetrafloroethylene copolymers, poly(chlorotrifluoroethylene), ethylene-chlorotrifluoroethylene copolymers, poly(vinylidene fluoride), poly(vinyl fluoride), and the like; polyamides, such as poly(6-aminocaproic acid) or poly(ε-caprolactam), poly(hexamethylene adipamide), poly(hexamethylene sebacamide), poly(11-aminoundecanoic acid), and the like; polyaramides, such as poly(imino-1,3-phenyleneiminoisophthaloyl) or poly(m-phenylene isophthalamide),and the like; parylenes, such as poly-p-xylylene, poly(chloro-p-xylylene), and the like; polyaryl ethers, such as poly(oxy-2,6-dimethyl-1,4-phenylene) or poly(p-phenylene oxide), and the like; polyaryl sulfones, such as poly(oxy-1,4-phenylenesulfonyl-1,4-phenyleneoxy-1,4-phenylene-isopropylene-1,4-phenylene), poly(sulfonyl-1,4-phenylenoxy-1,4-phenylenesulfonyl-4,4'-biphenylene), and the like; polycarbonates, such as poly(bisphenol A) or poly(carbonyldioxy-1,4-phenyleneiospropylidene-1,4-phenylene), and the like; polyesters, such as poly(ethylene terephthalate), poly(tetramethylene terephthalate), poly(cyclohexylene-1,4-dimethylene terephthalate) or poly(oxymethylene-1,4-cyclohexylenemethyleneoxyterephthaloyl), and the like; polyaryl sulfides, such as poly(p-phenylene sulfide) or poly(thio-1,4-phenylene), and the like; polyimides, such as poly(pyromellitimido-1,4-phenylene), and the like; polyolefins, such as polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), poly(vinyldiene chloride), polystyrene, and the like; copolymers of the foregoing, such as acrylonitrilebutadiene-styrene (ABS) copolymers, and the like; and the like. In addition, such term is meant to include blends of two or more polymers and random and block copolymers prepared from two or more different monomers.

Thermoplastic polyolefins are preferred and include polyethylene, polypropylene, poly(1-butene), poly(2-butene), poly(1-butene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), poly)vinylidene chloride), polystyrene, and the like.

The more preferred polyolefins are those which contain only hydrogen and carbon atoms and which are prepared by the addition polymerization of one or more unsaturated monomers. Examples of such polyolefins include, among others, polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polystyrene, and the like. Because of their commercial importance, the most preferred polyolefins are polyethylene and polypropylene.

Minor amounts of other materials also can be present, such as melt additives, pigments, stabilizers, plasticizers, delustrants, antioxidants, melt flow regulators, and the like.

Process Description

Figure 2:
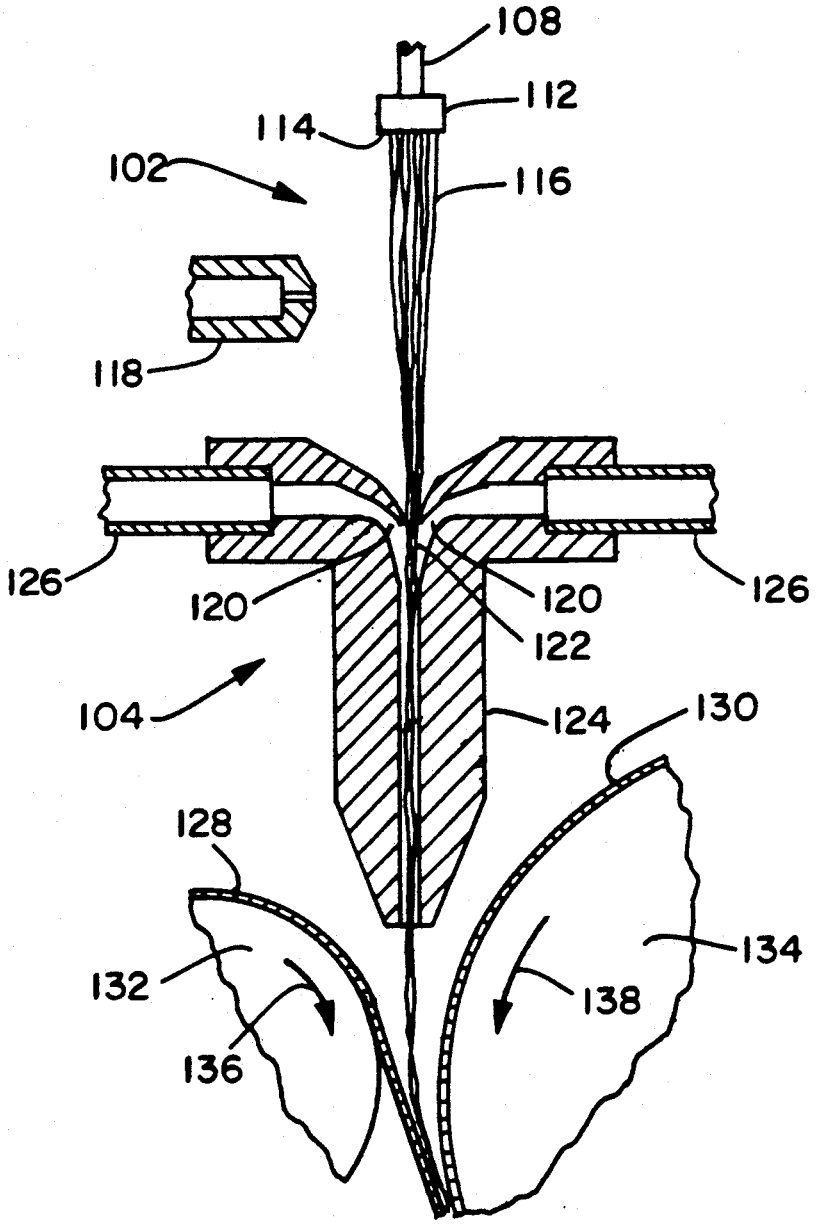
FIG. 2 is a schematic cross-sectional view of assembly 102 of FIG. 1, taken along line 2—2.

The method of the present invention perhaps is best understood with reference to FIGS. 1 and 2. FIG. 1 is a schematic representation of a hydraulic spinning apparatus suitable for use in the method of the present invention. The components includes a screw extruder (not shown), a melt metering gear pump (not shown), die and quench assembly 102, drawing assembly 104, and high-speed, twin-wire former 106. The screw extruder and gear pump may be located some distance from the other apparatus. Molten polymer is introduced into die assembly 112 by means of heated conduit 108. Quenching means 110 also may be present.

A molten thermoplastic polymer is pumped to die assembly 112 which, except for the die and heated conduit in order to simplify the drawing, is shown in FIG. 2 is cross-section along line 2—2 of FIG. 1. With reference now to FIG. 2, molten thermoplastic polymer passes into heated conduit 108 and then into die 112. The molten polymer then exits from face 114 of die 112 through 196 orifices arranged in eight rows along the length of the die to form a plurality of filaments 116 which at this stage are molten. Face 114 of die 112 has a length of about 6 inches (15.2 cm) and a width of about 1.5 inches (about 3.8 cm).

Filaments 116 move downwardly past ultrasonic spray nozzle 118, from which quenching liquid is sprayed to at least partially cool filaments 116. Spray nozzle 118 is equivalent to quenching means 110 of FIG. 1. Filaments 116 then enter drawing assembly 104 which draws filaments 116 and deposits them onto a forming wire. Drawing assembly 104 comprises high-speed water jets 120, throat 122, and forming nozzle 124. Filaments 116 enter open throat 122 of drawing assembly 104 and are entrained in high-speed water jets 120 which draw filaments 116 and carry them into 24-inch (61-cm) long forming nozzle 124. Water is supplied to jets 120 by twin manifolds 126 which are capable of delivering water to the jets at pressures sufficient to achieve exit velocities greater than 5,000 feet/minute or fpm (about 25.4 m/s). Liquid flow in the throat and nozzle is highly turbulent and complex. The nozzle exit gap typically is 0.375 inch (about 1.0 cm), with each jet gap set at about 0.1 inch (about 0.25 cm). Throat 120 and the upper portion of nozzle 124 form an open channel, and air is entrained with filaments 116 as they enter throat 122 of drawing assembly 104. Normally, excess nozzle volume is used to prevent flooding or overflow as the high-speed water streams merge in the throat region, although it is possible to operate and draw filaments in a flooded condition. Lower in the nozzle, the flow, driven primarily by the jet momentum, fills the nozzle as it decelerates and air is purged upward into the open throat. High-speed motion analysis of the flow in the nozzle at a distance of about 6 inches (about 15.2 cm) below the throat indicates that the mean speed of the water has been reduced to about 65 percent of that calculated for the maximum speed. Entrained air in this region helps visualize the flow which is quite two-dimensional, i.e. lacking in cross flow, in spite of apparent recirculations, unsteady conditions, velocity gradients and release of air bubbles. The observed speeds are consistent with an expected deceleration to about 55 percent of the jet speed lower in the nozzle with gap settings as described above.

Alternative design as of die and quench assembly 102, drawing assembly 104, and the filament collection means represented by twin-wire former 106 are possible. For example, circular arrangements of orifices maybe substituted for the rectilinear array described and an annular drawing jet might be used in place of the opposing linear jets described.

After passing through nozzle 124, filaments 116 and water emerge from drawing assembly 104. The filaments are deposited between the two forming wires, outer wire 128 and inner wire 130, after outer wire 128 has left breast roll 132 and while inner wire 130 still is on forming roll 134. Breast roll 132 is rotating in the direction of arrow 136 and forming roll 134 is rotating in the direction of arrow 138. Dewatering occurs around forming roll 134 by centrifugal force and pressure from the tension of the wires around forming roll 134.

Returning to FIG. 1, drawing assembly 104 is located between forming roll 134 and breast roll 132 of twin-wire former 106. Breast roll 132 has a diameter of 14 inches (about 35.6 cm) and forming roll 134 has a diameter of 30 inches (about 76 cm). the water exiting from nozzle 124 passes through outer wire 128 and into catcher 140. The water, typically at ambient temperature, is recycled. The water retained by catcher 140 is returned to a reservoir (not shown) from which the water is drawn and pumped to drawing assembly 104 via manifolds 126. If desired, additional dewatering can be achieved through the use of one or more of vacuum boxes 142 which re located under outer wire 128 after inner wire 130 has been lifted from filaments 116 on outer wire 128.

As already noted, the polymer melting system, including the polymer supply hopper and gear pump, may be some distance from the hydraulic spinning unit itself. The water that is used to attenuate the filaments is pumped from the reservoir into a "T" fitting where the water stream is divided into two streams. The volume of each stream is controlled with a valve so that the flow to the water jets can be adjusted individually. Such flow rates typically are equal, but they can be unequal, if desired. Alternatively, each water jet can be supplied from a separate reservoir, in which case the attenuating liquids can be the same or different.

Crimp and lay-down of the filaments depend, at least in part, on the relative linear velocities of the jet stream at the nozzle exit and the forming wires. For example, the filaments can be laid down with a high degree of crimp which results from a high jet to wire speed ratio. Alternatively, a low jet to wire speed ratio results in filaments which are very straight and highly oriented in the machine direction. Stated differently, for a given jet speed, the degree of crimp observed in the filaments increases as the linear speed of the forming wires decreases. This ability to impart varying degrees of crimp in the filaments during the spinning process is one of the unique features of hydraulic spinning.

Some of the process variables include the distance of spray nozzle 118 from face 114 of die 112, the distance of throat 122 from face 114, the speed of the water entering throat 122 and nozzle 124 (the drawing or attenuating zone), and the wire speed. Typical dimensions are given in the examples which follow.

Process Variables

It is necessary to balance a number of process elements or variables to optimize runability, filament properties, and tow or web properties. A general description of the process with examples of how the process variables may be balanced follows.

Extrusion Step

As shown by the examples, extrusion rates of 0.45, 0.90, 1.0, and 1.5 grams per hole per minute (ghm) were investigated. However, both higher and lower extrusion rates can be employed, if desired, depending in part upon extrusion temperature and the melt flow characteristics of the polymer. A practical extrusion rate or throughput range is from about 0.25 to about 2.5 ghm.

Quenching Step

Molten filaments exit from the die orifices with a low speed and are accelerated downward by gravity. Quenching of the filaments is accomplished by means of a quenching fluid having a temperature less than that of the filaments and a zero to high imposed velocity. The quenching fluid can be a gas, such as air, or a liquid. While the quenching fluid can be either heated or cooled, most often the quenching fluid will be at ambient temperature. The velocity of the quenching fluid can vary form essentially zero to a relatively high velocity, so long as the molten filaments are not significantly disrupted or deflected. As a practical matter, low velocities are preferred in order to avoid deflecting the descending filaments. The quenching fluid preferably is a gas or liquid droplet dispersion, with the latter being most preferred. When a liquid droplet dispersion is employed, the preferred liquid is aqueous. A particularly useful technique for generating a very low velocity droplet dispersion or mist is sonic generation.

Entraining and Drawing Step

Next, the quenched filaments enter the nozzle throat 122 of the drawing assembly 104 and are impinged by the attenuating liquid by means of high-speed jets 120. In general, the angle at which the drawing or attenuating water jets impinge the filaments in the throat of the nozzle can vary from less than about 45 degrees to almost zero degrees. It is preferred that the water jets enter the throat of the nozzle almost parallel with the direction of motion of the filaments. If the water jets enter the throat of the composite inlet at larger angles to the direction of motion of the filaments, a substantial amount of backflow and loss of forward momentum will result with less effective drawing of filaments in the attenuating liquid. Although practical equipment design requires a non-zero impingement angle, it is apparent that the smaller the angle relative to the movement of filament or direction of filament flow, the better in terms of reducing throat turbulence and providing more effective filament drawing.

In general, the attenuating liquid will have a speed of at least about 400 feet/minute (about 2 m/s). Preferably, the speed of the attenuating liquid will be in the range of from about 900 to about 5,000 feet/minute (about 4.5 to about 25 m/s); such speed most preferably will be in the range of from about 1,500 to about 5,000 feet/minute (about 7 to about 25 m/s).

It should be noted that the two-dimensional design of the nozzle shown in FIG. 2 is either critical nor necessary. That is, other nozzle designs can be utilized. For example, the nozzle can be cylindrical or tubular with a circular exit gap for attenuating liquid; such gap can be continuous or discontinuous.

The nozzle typically is set up with the sides of the internal channel of the nozzle being equidistant for the entire width of the nozzle beyond the throat zone. However, other nozzle configurations are permissible. Thus, the internal channel of the nozzle could gradually become more narrow (converging) or it could gradually become wider (diverging). Alternatively, the nozzle can have both converging the diverging sections. Parallel or converging nozzle configurations are preferred for smooth flow and air ejection.

It should be noted that the water jets entrain a substantial amount of air. In general, entrapment of air is dimensioned as the relative volume of liquid flowing into the nozzle increases. That is, at wider jet nozzle gaps there will be less air entrapped at the same throat dimensions. Air entrapment, however, is not known to be critical to process runnability or filament formation.

It has been observed during the running of the process that, if all other factors are kept equal without making any changes except in polymer throughput, the diameters of the filaments may not be greatly affected and under some conditions may actually decrease as throughput increases. This latter result is the opposite of what one having ordinary skill in the art would have expected, especially when the process is compared to spunbonding. Anomolies have been noted while attempting to correlate several filament properties, such as tenacity, birefringence, diameter, and strain at break, with the speed of the attenuating liquid. These properties have shown a discontinuity in their correlation with attenuating liquid speed at about 1800 feet/minute (30 feet/sec or about 9.1 m/s). For the given trail conditions, both tenacity and birefringence exhibited a minimum at a jet speed of about 30 fps. The diameter and breaking strain show a break in the linear relationship with increasing attenuating liquid speed under the process conditions studied. The break also occurs at about 30 fps.

Filament Lay-Down

The attenuating liquid volume flow and jet gap determine the jet speed which does not have to be connected in any way wire speed. That is, the method can be carried out with independently selected wire and jet speeds over a wide range of speeds. Experience thus far indicates that the filament properties are not affected significantly by the ratio of jet speed to wire speed, although the ratio does effect the structure of the tow or the nonwoven web which is collected on the forming wire as already described. It has been found that, with the composite inlet used, a jet opening greater than about 0.12 inch (about 0.3 cm), has a tendency to cause flooding in the throat 122 when the nozzle gap is 0.375 inch (about 1 cm). As used herein, "flooding" means only the accumulation of water at the top of the throat, so that the filaments in essence enter a pool of water before being picked up by the jets and forced through the nozzle. Such a water pool is not known to be a problem, except at start up. It also has been found that a nozzle exit gap of from about 0.25 to about 0.375 inch (from about 0.64 to about 1 cm) tends to be a useful range.

It may be noted that the forming wire orientations are such that the outer and inner wires form a nip at a shallow angle with respect to the direction of motion of the drawn filaments. Thus, the filaments enter the wire nip a short distance from the nozzle exit and at a shallow angle to the forming roll 134 surface tangent. Such orientation clearly will have an effect on the manner in which the filaments are layed down. The nearly parallel arrangement employed is believed to have contributed to the highly unidirectional machine direction orientation of the filaments in the nonwoven web. Other arrangements are permissible, however. For example, the drawing assembly 104 can be oriented at a greater angle to outer wire 128, in which case the filaments will be laid down closer to breast roll 132 unless the forming roll 134 is moved further away from the nozzle. It should be recognized that larger angles and slower wire speeds will result in a more random lay down of filaments on the forming wire 128. Moreover, single wire formers may be used for filament collection instead of the twin-wire former described, allowing larger lay-down angles.

As noted earlier, the attenuating liquid can contain discontinuous fibers or particles. In such case, a composite web results in which the discontinuous fibers or particles are interspersed among the filaments. The discontinuous fibers can be used to provide stabilization and/or bonding for the filaments.

The present invention is further illustrated by the examples which follows. Such examples, however, are not to be construed as in any way limiting either the spirit or scope of the present invention.

EXAMPLES 1-16

Filaments and nonwoven webs were prepared essentially as described above from a commercially available melt-extrusion grade polypropylene. The ratio of wire speed in the throat was about 0.67. In addition, the width of the nozzle was 0.375 inch (about 1 cm) and the width of the opening for each of the water jets in the throat of the composite inlet was 0.104 inch (about 0.26 cm). Quenching of the filaments was accomplished by a water mist generated by two sonic units (i.e., spray nozzle 118 in FIG. 2) located in either of two positions relative to the die face and roughly 1.5 to 2 inches (about 4 to 5 cm) from the closest filaments. In the high position, the sonic units were located about 3 inches (about 7 cm) below the die face; in the low position, such distance was about 7-10 inches (about 18-25 cm). The sonic units were spaced so that that the mist generated by them encompassed the entire width of the filament curtain. The filaments produced had a somewhat crimped look and a surface texture which resulted at least in part from variations in the diameter of individual filaments. The water-mist quench was not employed in Examples 6, 8, 10, and 12; a stationary (zero velocity) air quench was employed instead.

A number of trials were conducted. The trails were designed to determine the extent to which filament properties can be correlated with process conditions. The process conditions are summarized in Table 1 and filament properties are summarized in Table 2. In Table 2, "Birefring." is birefingence, and the units for the "Denier" column are g per 9,000 m. Note that there are two rows of data in Table 2 for each example. The first row consists of mean values based on 8-10 replicates. While the second row consists of standard deviations for the means values given in the first row.

TABLE 1

Summary of Process Conditions

| Example | Jet speed (fpm) | Throughput (ghm) | Extrusion Temp., °C. | Quench Conditions Gal./h | Quench Conditions Position |
|---|---|---|---|---|---|
| 1 | 3,600 | 0.90 | 260 | 3.3 | High |
| 2 | 3,600 | 0.90 | 260 | 3.3 | Low |
| 3 | 3,600 | 0.45 | 260 | 3.3 | High |
| 4 | 3,600 | 0.45 | 260 | 3.3 | Low |
| 5 | 3,600 | 0.90 | 238 | 3.3 | Low |
| 6 | 3,600 | 0.90 | 238 | 0.0 | N/A |
| 7 | 3,600 | 0.45 | 238 | 3.3 | Low |
| 8 | 3,600 | 0.45 | 238 | 0.0 | N/A |
| 9 | 2,400 | 0.90 | 238 | 3.3 | Low |
| 10 | 2,400 | 0.90 | 238 | 0.0 | N/A |
| 11 | 2,400 | 0.45 | 238 | 3.3 | Low |
| 12 | 2,400 | 0.45 | 238 | 0.0 | N/A |
| 13 | 1,800 | 0.90 | 260 | 3.3 | High |
| 14 | 1,800 | 0.90 | 260 | 3.3 | Low |
| 15 | 1,800 | 0.45 | 260 | 3.3 | High |
| 16 | 1,800 | 0.45 | 260 | 3.3 | Low |

TABLE 2

Summary of Filament Properties

| Example | Diameter (μm) | Birefring. (×1000) | Denier | Tenacity (g/d) | Strain (%) | Modulus (g/d) |
|---|---|---|---|---|---|---|
| 1 | 16 | 24 | 2.0 | 2.4 | 145 | 13.5 |
| | 5.1 | 2.6 | 1.3 | 0.7 | 55 | 13.3 |
| 2 | 21 | 28 | 2.8 | 2.1 | 176 | 14.1 |
| | 3.3 | 2.2 | 0.9 | 1.6 | 100 | 12.4 |
| 3 | 15 | 27 | 1.5 | 2.8 | 158 | 12.8 |
| | 1.8 | 3.3 | 0.3 | 0.6 | 28 | 5.7 |
| 4 | 18 | 24 | 2.2 | 2.9 | 202 | 16.8 |
| | 2.6 | 3.4 | 0.6 | 1.4 | 94 | 3.3 |
| 5 | 27 | 24 | 4.6 | 1.9 | 330 | 5.3 |
| | 2.9 | 4.2 | 0.9 | 1.3 | 101 | 2.3 |
| 6 | 23 | 29 | 3.5 | 2.8 | 89 | 17.2 |
| | 3.0 | 2.1 | 0.9 | 0.7 | 28 | 5.6 |
| 7 | 26 | 19 | 4.2 | 1.9 | 274 | 3.9 |
| | 1.8 | 2.7 | 0.6 | 0.2 | 67 | 1.3 |
| 8 | 22 | 20 | 3.2 | 2.3 | 252 | 6.5 |
| | 1.2 | 2.0 | 0.3 | 0.2 | 58 | 1.8 |
| 9 | 26 | 26 | 4.2 | 2.2 | 204 | 10.7 |
| | 9.0 | 5.2 | 4.2 | 0.9 | 85 | 6.4 |
| 10 | 32 | 24 | 6.9 | 2.4 | 212 | 19.7 |
| | 8.3 | 8.3 | 3.4 | 1.6 | 113 | 15.7 |
| 11 | 25 | 20 | 4.1 | 2.1 | 282 | 4.2 |
| | 1.2 | 3.0 | 0.4 | 0.2 | 40 | 0.8 |
| 12 | 22 | 23 | 3.3 | 2.3 | 201 | 9.5 |
| | 3.4 | 4.9 | 1.0 | 0.6 | 78 | 8.5 |
| 13 | 17 | 26 | 2.0 | 2.1 | 135 | 11.5 |
| | 3.5 | 2.9 | 0.7 | 0.6 | 51 | 9.0 |
| 14 | 31 | 15 | 6.2 | 1.3 | 312 | 2.7 |
| | 4.2 | 5.2 | 1.6 | 0.5 | 66 | 1.7 |
| 15 | 20 | 21 | 2.7 | 1.9 | 244 | 5.7 |
| | 2.7 | 5.0 | 0.8 | 0.5 | 77 | 2.5 |
| 16 | 25 | 18 | 4.1 | 1.6 | 461 | 5.2 |
| | 3.7 | 5.7 | 1.4 | 0.4 | 110 | 3.4 |

For convenience, the data in Table 2 are organized by extrusion temperature and quench rate in Table 3-6, inclusive. The tables also include jet speed and throughput. For convenience in organizing the tables, the following abbreviations were used: Ex. is Example, J.S. is Jet Speed, T.P. is Throughput, Biref. is Birefringence, Ten. is Tenacity, Strain is Strain at Break, and Mod. is Modulus.

TABLE 3

| Summary of Filament Properties Extruded at 238° C. with Low Quench | | | | | | | |
|---|---|---|---|---|---|---|---|
| Ex. | J.S. (fpm) | T.P. (ghm) | Dia. (μm) | Biref. ($\times 10^3$) | Ten. (g/d) | Strain (%) | Mod. (g/d) |
| 11 | 2400 | 0.45 | 25 | 20 | 2.1 | 282 | 4.2 |
| 7 | 3600 | 0.45 | 25 | 19 | 1.9 | 274 | 3.8 |
| 9 | 2400 | 0.90 | 28 | 25 | 2.0 | 216 | 9.0 |
| 5 | 3600 | 0.90 | 25 | 24 | 2.5 | 347 | 5.5 |

TABLE 4

| Summary of Filament Properties Extruded at 238° C. with No Quench | | | | | | | |
|---|---|---|---|---|---|---|---|
| Ex. | J.S. (fpm) | T.P. (ghm) | Dia. (μm) | Biref. ($\times 10^3$) | Ten. (g/d) | Strain (%) | Mod. (g/d) |
| 12 | 2400 | 0.45 | 22 | 23 | 2.3 | 201 | 9.5 |
| 8 | 3600 | 0.45 | 22 | 20 | 2.3 | 252 | 9.3 |
| 10 | 2400 | 0.90 | 32 | 25 | 2.4 | 212 | 19.7 |
| 6 | 3600 | 0.90 | 23 | 29 | 2.8 | 89 | 17.2 |

TABLE 5

| Summary of Filament Properties Extruded at 260° C. with Low Quench | | | | | | | |
|---|---|---|---|---|---|---|---|
| Ex. | J.S. (fpm) | T.P. (ghm) | Dia. (μm) | Biref. ($\times 10^3$) | Ten. (g/d) | Strain (%) | Mod. (g/d) |
| 16 | 1800 | 0.45 | 25 | 18 | 1.6 | 461 | 12.6 |
| 4 | 3600 | 0.45 | 18 | 24 | 2.9 | 202 | 11.5 |
| 14 | 1800 | 0.90 | 31 | 15 | 1.3 | 312 | 2.7 |
| 2 | 3600 | 0.90 | 20 | 27 | 2.8 | 182 | 18.1 |

TABLE 6

| Summary of Filament Properties Extruded at 260° C. with High Quench | | | | | | | |
|---|---|---|---|---|---|---|---|
| Ex. | J.S. (fpm) | T.P. (ghm) | Dia. (μm) | Biref. ($\times 10^3$) | Ten. (g/d) | Strain (%) | Mod. (g/d) |
| 15 | 1800 | 0.45 | 20 | 21 | 1.9 | 244 | 5.7 |
| 3 | 3600 | 0.45 | 15 | 27 | 2.8 | 158 | 12.8 |
| 13 | 1800 | 0.90 | 17 | 26 | 2.1 | 135 | 11.5 |
| 1 | 3600 | 0.90 | 17 | 27 | 2.4 | 145 | 13.6 |

For the range of conditions studied, the following conclusions were derived from a statistical analysis of the data in Tables 2-6 inclusive:

(1) polymer throughput had no significant effect on filament properties except for modulus which was higher at 0.9 ghm than at 0.45 ghm;

(2) filaments produced at 260° C. were smaller, stronger, and less extendable, and had higher modulus than those produced at an extrusion temperature of 238° C.;

(3) although filaments produced without water-mist quenching at 238° C. were the same size as quenched filaments, they were stronger, less extendable, and had a higher modulus;

(4) positioning the spray quench closer to the die face in the 260° C. process produced smaller, less extendable filaments without changing tenacity or modulus;

(5) at an extrusion temperature of 260° C., the higher jet speeds produced smaller, stronger, less extendable, and higher modulus filaments than lower jet speeds;

(6) higher jet speeds produced smaller filaments than somewhat lower speed at 238° C., but did not significantly change other properties; and (7) birefringence data for all samples are in reasonable agreement with the mechanical properties data.

EXAMPLES 17-29

Additional experiments then were carried out to extend the range of process conditions or variables, with emphasis on both increased polymer throughput rates and reduced jet velocities. The inlet throat design also was changed from the more shallow design used in Examples 1-16 to a deeper throat design with jet gaps of 0.089 inch (about 0.23 cm). However, the throat design did not appear to have a significant effect on either the process itself or filament properties under similar conditions. As with the preceding examples, process conditions for Examples 17-29 are summarized in Table 7 and filament properties are summarized in Table 8.

TABLE 7

| Summary of Process Conditions | | | | | |
|---|---|---|---|---|---|
| Example | Jet speed (fpm) | Throughput (ghm) | Extrusion Temp., °C. | Quench Conditions Gal./h | Quench Conditions Position |
| 17 | 900 | 1.0 | 249 | 3.3 | High |
| 18 | 1,200 | 1.0 | 249 | 3.3 | High |
| 19 | 1,800 | 1.0 | 249 | 3.3 | High |
| 20 | 2,400 | 1.0 | 249 | 3.3 | High |
| 21 | 3,000 | 1.0 | 249 | 3.3 | High |
| 22 | 900 | 1.5 | 249 | 3.3 | High |
| 23 | 1,200 | 1.5 | 249 | 3.3 | High |
| 24 | 1,800 | 1.5 | 249 | 3.3 | High |
| 25 | 900 | 1.5 | 249 | 3.3 | Low |
| 26 | 1,200 | 1.5 | 249 | 3.3 | Low |
| 27 | 1,800 | 1.5 | 249 | 3.3 | Low |
| 28 | 2,400 | 1.5 | 249 | 3.3 | Low |
| 29 | 3,000 | 1.5 | 249 | 3.3 | Low |

TABLE 8

| Summary of Filament Properties | | | | |
|---|---|---|---|---|
| Example | Diameter (μm) | Birefring. ($\times 1000$) | Tenacity (g/d) | Strain (%) |
| 17 | 21 | 22 | 2.1 | 177 |
| | 8.0 | 3.5 | 0.5 | 43 |
| 18 | 14 | 21 | 1.9 | 129 |
| | 4.2 | 2.1 | 1.0 | 64 |
| 19 | 21 | 19 | 1.5 | 179 |
| | 5.3 | 3.0 | 0.4 | 68 |
| 20 | 14 | 25 | 2.4 | 116 |
| | 2.4 | 3.3 | 0.8 | 38 |
| 21 | 12 | 27 | 2.8 | 90 |
| | 2.8 | 4.1 | 1.2 | 26 |
| 22 | 15 | 23 | 2.2 | 165 |
| | 2.8 | 1.6 | 0.4 | 54 |
| 23 | 14 | 22 | 2.2 | 150 |
| | 3.1 | 2.7 | 0.6 | 39 |
| 24 | 14 | 23 | 2.2 | 130 |
| | 5.4 | 3.6 | 0.6 | 52 |
| 25 | 38 | 22 | 2.4 | 364 |
| | 11.6 | 5.0 | 0.8 | 134 |
| 26 | 47 | 16 | 1.3 | 383 |
| | 9.4 | 9.8 | 0.6 | 44 |
| 27 | 31 | 18 | 1.7 | 259 |
| | 14.7 | 9.9 | 1.1 | 176 |
| 28 | 25 | 21 | 2.0 | 327 |
| | 5.2 | 5.3 | 0.7 | 97 |
| 29 | 29 | 20 | 1.3 | 177 |
| | 9.4 | 8.1 | 0.8 | 95 |

Minimum filament diameter values were calculated for a number of Examples 1-29 by assuming that the final filament speed is equal to that of the drawing fluid maximum speed. The model for the calculations was one in which the filaments are accelerated from a low speed (about 20 fpm or about 0.1 m/s) near the face of the die to a linear speed approaching that of the drawing or attenuating fluid in the throat of the drawing assembly. Under such conditions, the final filament diameter in micrometers will be proportional to the square root of the ratio of these two velocities. For the die face design employed and assuming a polymer density of 0.9 g/cc, filament diameter can be expressed as follows:

$$D=2154\sqrt{(ghm/fpm)}$$

in which the filament melt speed is expressed as the throughput rate in grams per hole per minute (ghm). The filament diameter then is in micrometers.

Such calculations were compared with observed mean filament diameters at various jet speeds, polymer throughput rates, and extrusion temperatures. Filament diameters were determined for 8 to 10 filaments from each sample by means of an optical microscope with a Filar eyepiece. It was found, however, that measurements made with from scanning electron microscope (SEM) photomicrographs on a filament distribution consisting of approximately 30 to 60 filaments gave diameter values which were roughly 35 percent higher than the optical microscope average values. The results of the optical microscope measurements are summarized in Table 9. In the table, "MFD" represents mean filament diameter.

TABLE 9

| | Mean Filament Diameters (MFD) | | | | | |
|---|---|---|---|---|---|---|
| Example | Jet speed (fpm) | Throughput (ghm) | Extrusion Temp., °C. | Quench | MFD (μm) Calc. | MFD (μm) Found |
| 17 | 900 | 1.0 | 249 | High | 72 | 21 |
| 22 | 900 | 1.5 | 249 | High | 88 | 15 |
| 25 | 900 | 1.5 | 249 | Low | 88 | 38 |
| 18 | 1,200 | 1.0 | 249 | High | 62 | 14 |
| 23 | 1,200 | 1.5 | 249 | High | 76 | 14 |
| 26 | 1,200 | 1.5 | 249 | Low | 76 | 47 |
| 15 | 1,800 | 0.45 | 260 | High | 34 | 20 |
| 16 | 1,800 | 0.45 | 260 | Low | 34 | 25 |
| 13 | 1,800 | 0.90 | 260 | High | 48 | 17 |
| 14 | 1.800 | 0.90 | 260 | Low | 48 | 31 |
| 19 | 1,800 | 1.0 | 249 | High | 51 | 21 |
| 24 | 1,800 | 1.5 | 249 | High | 62 | 14 |
| 27 | 1,800 | 1.5 | 249 | Low | 62 | 31 |
| 11 | 2,400 | 0.45 | 238 | Low | 29 | 25 |
| 12 | 2,400 | 0.45 | 238 | None | 29 | 23 |
| 9 | 2,400 | 0.90 | 238 | Low | 42 | 26 |
| 10 | 2,400 | 0.90 | 238 | None | 42 | 32 |
| 20 | 2,400 | 1.0 | 249 | High | 44 | 13 |
| 28 | 2,400 | 1.5 | 249 | Low | 54 | 25 |
| 21 | 3,000 | 1.0 | 249 | High | 39 | 12 |
| 29 | 3,000 | 1.5 | 249 | Low | 48 | 29 |
| 3 | 3,600 | 0.45 | 260 | High | 24 | 15 |
| 4 | 3,600 | 0.45 | 260 | Low | 24 | 18 |
| 7 | 3,600 | 0.45 | 238 | Low | 24 | 25 |
| 8 | 3,600 | 0.45 | 238 | None | 24 | 22 |
| 1 | 3,600 | 0.90 | 260 | High | 34 | 16 |
| 2 | 3,600 | 0.90 | 260 | Low | 34 | 21 |
| 5 | 3,600 | 0.90 | 238 | Low | 34 | 27 |
| 6 | 3,600 | 0.90 | 238 | None | 34 | 23 |

The data in Table 9 illustrate an important characteristic of filaments prepared by hydraulic spinning in accordance with the present invention; namely, filament diameters significantly less than those predicted from a linear attenuation model are observed under many conditions. Since the values in the table are mean values, it should be clear that individual filament diameters much smaller than the mean values often are observed.

In addition, the optical measurements illustrate a second important characteristic of filaments obtained in accordance with the present invention; the variability of hydraulically spun filament properties is high. This can be seen from the standard deviation rows in Tables 2 and 8. The mean results for filament properties also point to this variability aspect. Based on the results reported in Tables 2 and 8:

(a) mean filament diameters ranged from about 12 to about 47 micrometers;
(b) means filament tenacities ranged from about 1.3 to about 2.9 g/denier;
(c) mean strain at break ranged from about 90 to about 380 percent;
(d) mean filament modulus values feel in the range from of about 5 to about 15 g/denier; and
(e) mean birefringence values ranged from about 0.016 to about 0.027.

Thus, hydraulic spinning is capable of producing fine denier filaments from synthetic thermoplastic polymers which have fair to excellent mechanical properties for nonwovens and composites.

If the corresponding values for individual filaments are examined, rather than mean values, broader ranges are appropriate for the filament characteristics listed above. For example, from the optical microscope measurements and SEM photomicrographs, it is evident that filaments having diameters as small as about 5 micrometers were obtained. Similarly, filaments having diameters larger than 47 micrometers were produced. Thus, it is expected that a realistic range of filament diameters is from about 5 to about 75 micrometers. Accordingly, realistic ranges for the above filament properties are as follows:

(a) filament diamters—from about 5 to about 75 micrometers;
(b) filament tenacities—from about 1 to about g/denier;
(c) strain at break—from about 35 to about 500 percent;
(d) filament modulus—from of about 2.5 to about 20 g/denier; and
(e) birefringence—0.010 to about 0.035.

Unexpected results of throughput and jet speed were observed, however, Filaments produced with a polymer throughput of 1.5 ghm were smaller, more oriented (more birefringent), and stronger than those extruded at a rate of 1.0 ghm. Jet speed effects interacted with throughput and quench conditions. With a throughput of 1.5 ghm and quench in the lowered position, about 10 inches from the die face, all filament properties were essentially invariant with jet speed. With 1.5 ghm throughput and quench in the high position, about 4 inches from the die face, little or no correlation of filament properties to jet speed was found, although diameter and strain showed weak correlation to speed. With a throughput of 1.0 ghm and quench in the high position, excellent linear correlation was found between all filament properties and jet speeds from 1,800 to 3,000 fpm, whereas either an inverse correlation or no correlation was found at speeds from 900 to 1,800 fpm.

Figure 3:
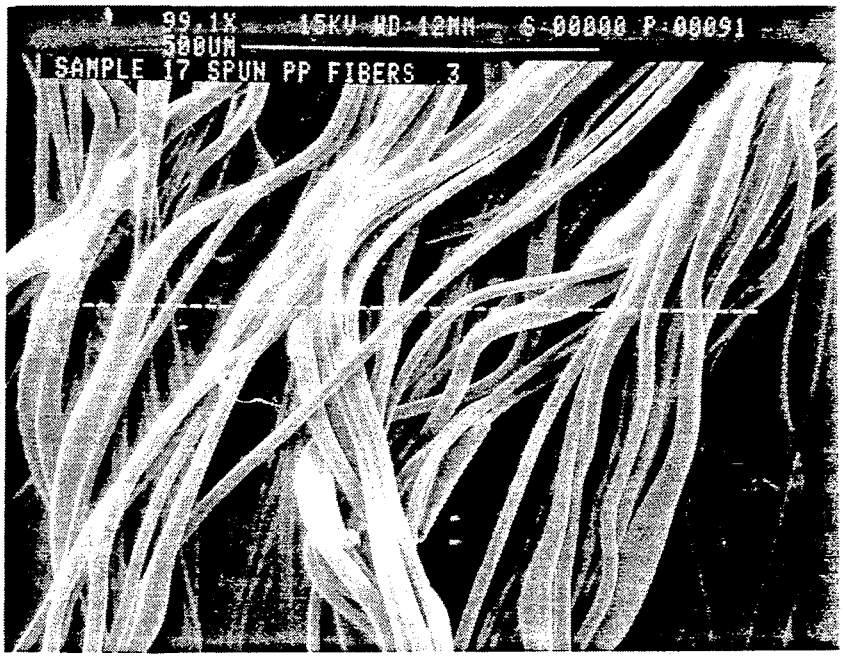
FIG. 3–7 are scanning electron microscope photomicrographs of filaments obtained in accordance with the present invention.
Figure 4:
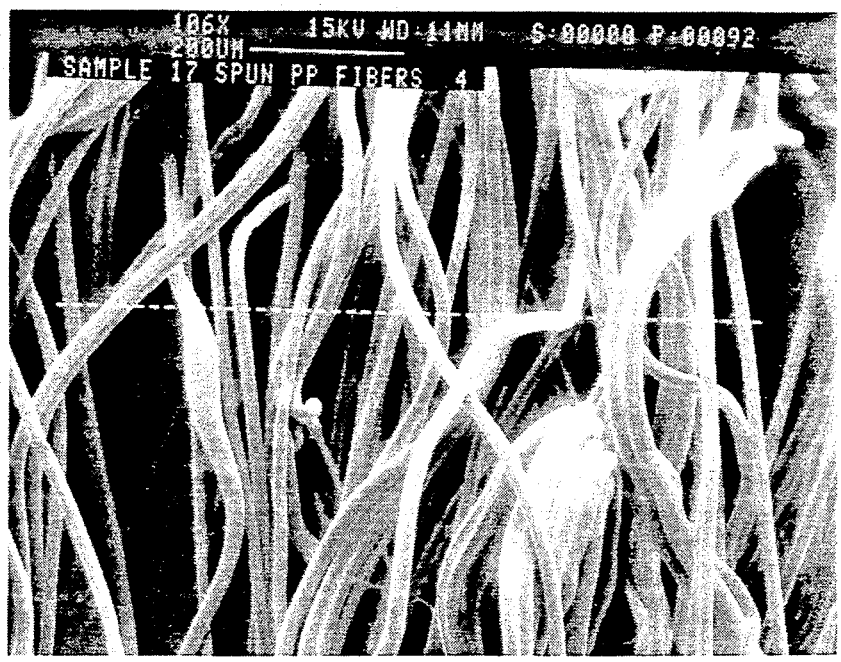
Figure 5:
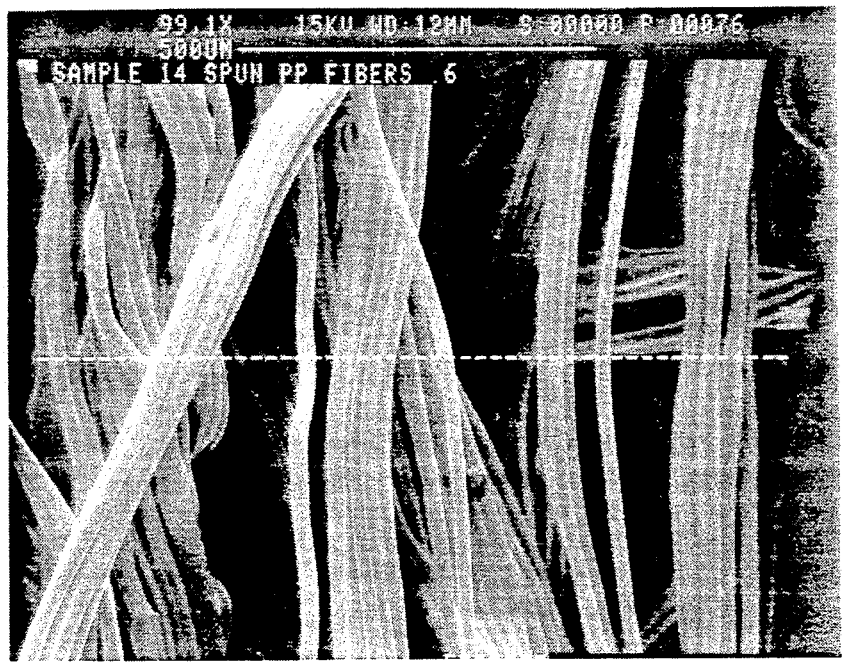
Figure 6:
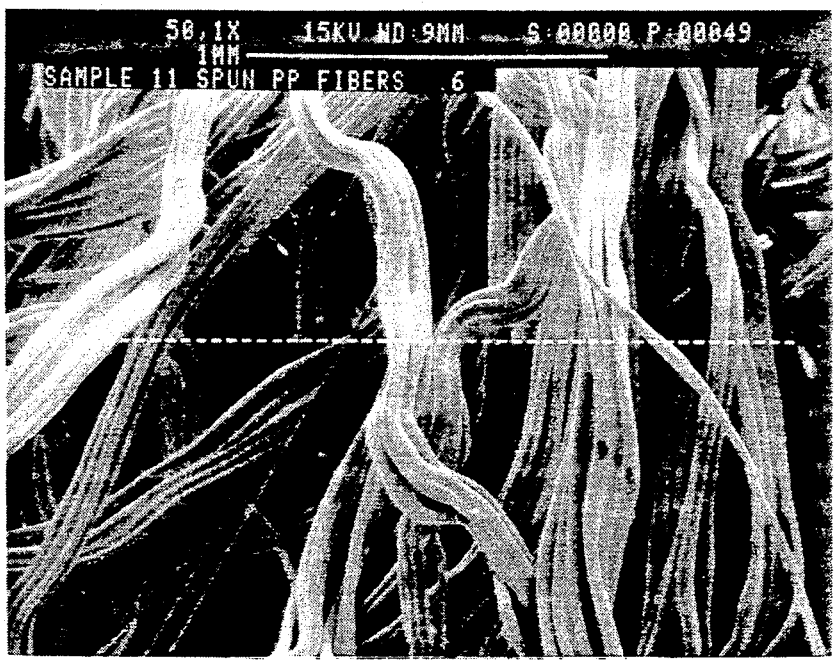
Figure 7:
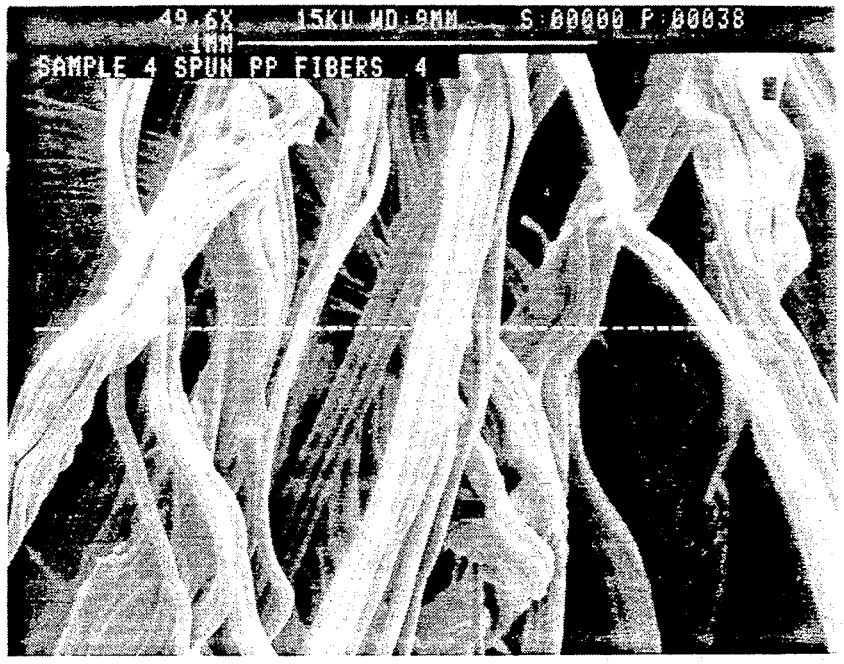

Finally, FIGS. 3-7 are SEM photomicrographs of several filament samples. FIGS. 3 and 4 are of the filaments of Example 3, while FIGS. 5, 6, and 7 are of the filaments of Examples 4, 9, and 10, respectively. Two important characteristics of hydraulically spun filaments are illustrated, i.e., the variability of diameter from fiber to fiber and along the length of any fiber and the occurrence of fiber bundles. Crimping is especially notable in FIGS. 6 and 7. The variability of filament properties in any sample which was noted above is certainly consistent with the variation in structure depicted in the photomicrographs and results from variability in the degree of filament attenuation with time or position in the process. The variable attenuation in turn contributes to unusual filament stress-strain properties by providing higher extensibility in the lesser drawn segments combined with higher strength or tenacity in the more highly drawn segments.

Having thus described the invention, numerous changes and modifications thereof will be readily apparent to those having ordinary skill in the art without departing from the spirit or scope of the invention.

What is claimed is:

1. A method of forming substantially continuous filaments which comprises the steps of:

A. extruding a molten thermoplastic polymer through a die having a plurality of orifices to give a plurality of substantially continuous filaments;

B. contacting said plurality of filaments with a quenching fluid having a temperature less than that of said plurality of filaments and a zero to high imposed velocity which, if other than zero, has a component which is in a direction other than parallel with the movement of said filaments;

C. entraining and drawing said plurality of filaments in a nozzle with an attenuating liquid having a linear speed of at least about 2 m/s; and D. separating the drawn filaments from the major portion of said attenuating liquid.

2. The method of claim 1, in which the drawn filaments are collected as tow.

3. The method of claim 1, in which said quenching fluid has a zero to low imposed velocity.

4. The method of claim 3, in which said quenching fluid is a gas.

5. The method of claim 3, in which said quenching fluid is a dispersion of water droplets in air.

6. The method of claim 1, in which said quenching fluid has a low to high imposed velocity.

7. The method of claim 6, in which said quenching fluid is air.

8. The method of claim 1, in which said attenuating liquid is water.

9. The method of claim 8, in which said attenuating liquid has a speed of from about 4.5 to about 25.4 m/s.

10. The method of claim 1, in which said thermoplastic polymer comprises a polyolefin.

11. The method of claim 10, in which said polyolefin is polypropylene.

12. The method of claim 1, in which said moving foraminous surface is part of a twin-wire former.

13. A method of forming a nonwoven web which is characterized by minimal filament-to-filament fusion bonding, which method comprises the steps of:

A. extruding a molten thermoplastic polymer through a die having a plurality of orifices to give a plurality of substantially continuous filaments;

B. contacting said plurality of filaments with a quenching fluid having a temperature less than that of said plurality of filaments and a zero to low imposed velocity which, if other than zero, has a component which is in a direction other than parallel with the movement of said filaments;

C. entraining and drawing said plurality of filaments in a nozzle with an attenuating liquid having a linear speed of at least about 2 m/s; and D. collecting the drawn filaments on a moving foraminous surface as a web of filaments and separating the major portion of the drawing liquid from said drawn filaments.

14. The method of claim 13, in which said quenching fluid has a zero to low imposed velocity.

15. The method of claim 14, in which said quenching fluid is a gas.

16. The method of claim 14, in which said quenching fluid is a dispersion of water droplets in air.

17. The method of claim 13, in which said quenching fluid has a low to high imposed velocity.

18. The method of claim 17, in which said quenching fluid is air.

19. The method of claim 13, in which said attenuating liquid is water.

20. The method of claim 19, in which said attenuating liquid has a speed of from about 4.5 to about 25.4 m/s.

21. The method of claim 19, in which said attenuating liquid contains either discontinuous fibers or particles.

22. The method of claim 21, in which said attenuating liquid contains discontinuous fibers.

23. The method of claim 22, in which said discontinuous fibers are wood pulp fibers.

24. The method of claim 13, in which said thermoplastic polymer comprises a polyolefin.

25. The method of claim 24, in which said polyolefin is polypropylene.

26. The method of claim 13, in which said moving foraminous surface is part of a twin-wire former.

27. Substantially continuous melt-extruded filaments prepared from a thermoplastic polymer, in which:

A. said filaments have an average diameter in the range of from about 5 to about 75 micrometers;

B. said filaments have a high variability of filaments diameter from filament to filament and along the length of any given filament; and C. at least some of said filaments are present as filament bundles.

28. The filaments of claim 27, in which said filaments have:

A. a tenacity in the range of from about 1 to about 4 g/denier;

B. a strain at break of from about 35 to about 500 percent;

C. a modulus of from about 2.5 to about 20 g/denier; and

D. a birefringence of from about 0.010 to about 0.035.

29. A tow which is comprised of the melt-extruded filaments of claim 27.

30. The filaments of claim 27, in which said thermoplastic polymer is a polyolefin.

31. The filaments of claim 30, in which said polyolefin is polypropylene.

32. The filaments of claim 30, in which said filaments have:

A. a mean diameter in the range of from about 12 to about 47 micrometers;

B. a mean tenacity in the range of from about 1.3 to about 2.9 g/denier;

C. a mean strain at break of from about 90 to about 380 percent;

D. a mean modulus of from about 5 to about 15 g/denier; and

E. a mean birefringence of from about 0.016 to about 0.027.

33. A nonwoven web comprised of substantially continuous melt-extruded filaments prepared from a thermoplastic polymer, in which:

A. said filaments have an average diameter in the range of from about 5 to about 75 micrometers;

B. said filaments have a high variability of filament diameter from filament to filament and along the length of any given filament;

C. at least some of siad filaments are present as filament bundles; and

D. said web is characterized by minimal filament-to-filament fusion bonding.

34. The nonwoven web of claim 33, in which said melt-extruded filaments have;

A. a tenacity in the range of from about 1 to about 4 g/denier;

B. a strain at break of from about 35 to about 500 percent;

C. a modulus of from about 2.5 to about 20 g/denier; and

D. a birefringence of from about 0.010 to about 0.035.

35. The nonwoven web of claim 33, in which said web is comprised of filaments which are highly oriented in the machine direction.

36. The nonwoven web of claim 33, in which said web contains discontinuous fibers or particles.

37. The nonwoven web of claim 33, in which said thermoplastic polymer is a polyolefin.

38. The nonwoven web of claim 37, in which said polyolefin is polypropylene.

39. The nonwoven web of claim 38, in which said filaments have:

A. a mean diameter in the range of from about 12 to about 47 micrometers;

B. a mean tenacity in the range of from about 1.3 to about 2.9 g/denier;

C. a mean strain at break of from about 90 to about 380 percent;

D. a mean modulus of from about 5 to about 15 g/denier; and

E. a mean birefringence of from about 0.016 to about 0.027.

* * * * *

UNITED STATES PATENT AND TRADEMARK OFFICE

CERTIFICATE OF CORRECTION

PATENT NO. : 5,244,723

DATED : September 14, 1993

INVENTOR(S) : Richard A. Anderson
Jark C. Lau

It is certified that error appears in the above-indentified patent and that said Letters Patent is hereby corrected as shown below:

Column 1, line 16, "even data in the names..." should read --...even date in the names...--;

Column 1, line 34, "randomly depending them..." should read --randomly depositing them...--;

Column 1, line 40/41, "to Butin et al. et al.,..." should read --to Butin et al.,...--;

Column 1, line 49, "Lohkamp, "melting..." should read --Lohkamp, "melt...--;

Column 1, line 54, "respect to melting blowing" should read --respect to meltblowing...--;

Column 2, line 12, "cited process have in..." should read --cited processes have in...--;

Column 3, line 51, "said filaments." should read --said filaments;--;

Column 4, line 30, "poly(m-phenylene..." should read --poly(m-phenylene...--;

UNITED STATES PATENT AND TRADEMARK OFFICE

CERTIFICATE OF CORRECTION

PATENT NO. : 5,244,723

DATED : September 14, 1993

INVENTOR(S) : Richard A. Anderson
Jark C. Lau

It is certified that error appears in the above-indentified patent and that said Letters Patent is hereby corrected as shown below:

Column 4, line 31, "such as poly-p-xylylene..." should read --such as poly-p-xylylene...---;

Column 4, line 31, "poly(chloro-p-xylylene)..." should read --poly(chloro-p-xylylene...--;

Column 4, line 33, "or poly(p-phenylene..." should read --or poly(p-phenylene...--;

Column 4, line 35, "4-phenylene-isopropylene..." should read --4-phenylene-isopropylidene...--;

Column 4, line 44/45, "such as poly(p-phenylene..." should read --such as poly(p-phenylene...--;

Column 9, line 52, "spaced so that that..." should read --spaced so that...--;

Column 9/10, line 68/1, "8-10 replicates. While.." should read --8-10 replicates, while...--;

UNITED STATES PATENT AND TRADEMARK OFFICE

CERTIFICATE OF CORRECTION

PATENT NO. : 5,244,723

DATED : September 14, 1993

INVENTOR(S) : Richard A. Anderson
Jark C. Lau

It is certified that error appears in the above-indentified patent and that said Letters Patent is hereby corrected as shown below:

Column 14, line 11, "modulus values feel in..." should read --modulus values fell in...--;

Column 14, line 42 "observed, however, Filaments..." should read --observed, however. Filaments...--;

Column 17, line 7, "some of siad filaments" should read --some of said filaments--;

Column 17, line 13, "filaments have;" should read --filaments have:"--.

Signed and Sealed this

Fourth Day of October, 1994

Bruce Lehman

*Attest:*

BRUCE LEHMAN

*Attesting Officer*

*Commissioner of Patents and Trademarks*